US008327501B2

(12) United States Patent
Arnold et al.

(10) Patent No.: US 8,327,501 B2
(45) Date of Patent: Dec. 11, 2012

(54) DUSTPAN

(75) Inventors: Peter L. Arnold, Heppenheim (DE); Hans Jorg Clemen, Heidelberg (DE)

(73) Assignee: Carl Freudenberg KG, Weinheim (DE)

( * ) Notice: Subject to any disclaimer, the term of this patent is extended or adjusted under 35 U.S.C. 154(b) by 712 days.

(21) Appl. No.: 12/299,734

(22) PCT Filed: May 4, 2007

(86) PCT No.: PCT/EP2007/003939

§ 371 (c)(1),
(2), (4) Date: Nov. 5, 2008

(87) PCT Pub. No.: WO2007/128508

PCT Pub. Date: Nov. 15, 2007

(65) Prior Publication Data

US 2009/0188070 A1 Jul. 30, 2009

(30) Foreign Application Priority Data

May 6, 2006 (DE) ..... 10 2006 021 165

(51) Int. Cl.
*A47L 13/52* (2006.01)

(52) U.S. Cl. ..... 15/257.2; 15/257.1

(58) Field of Classification Search ..... 15/257.2, 15/257.1, 257.7
See application file for complete search history.

(56) References Cited

U.S. PATENT DOCUMENTS

| | | | | |
|---|---|---|---|---|
| 614,858 | A | 11/1898 | Grove | |
| 2,864,117 | A | 9/1955 | Williams | |
| 5,425,153 | A * | 6/1995 | Vosbikian | 15/257.2 |
| 5,594,975 | A * | 1/1997 | Christen | 16/422 |
| 6,643,891 | B1 | 11/2003 | Jerstroem et al. | |
| 7,404,229 | B2 * | 7/2008 | Monahan et al. | 15/257.4 |
| 7,600,287 | B1 * | 10/2009 | Moore et al. | 15/144.4 |
| 2005/0060831 | A1 * | 3/2005 | Berti | 15/257.2 |

FOREIGN PATENT DOCUMENTS

| | | | |
|---|---|---|---|
| DE | 4129246 | C1 | 1/1993 |
| EP | 382658 | A1 * | 8/1990 |
| GB | 2168599 | A | 6/1986 |
| JP | 10262890 | A | 10/1998 |
| WO | WO 03/059141 | A1 | 7/2003 |

* cited by examiner

*Primary Examiner* — Shay Karls
(74) *Attorney, Agent, or Firm* — Leydig, Voit & Mayer, Ltd

(57) ABSTRACT

A dustpan (1) is provided that includes a base body (2) that has an essentially triangular base area (3). One edge of the base body is constructed as the sweeping edge (4) and the two other edges each have a side wall (5, 6). A stem (7) that projects essentially at a right angle from the base area (3) for proper use can be attached to the base body (2). At least one side wall (5) is constructed as a standing surface.

10 Claims, 4 Drawing Sheets

DUSTPAN

FIELD OF THE INVENTION

The invention relates to a dustpan with a base body that has an essentially triangular base surface, wherein one edge is formed as a sweeping edge and the two other edges each have a side wall, wherein a stem can be attached to the base body.

BACKGROUND OF OF THE INVENTION

From DE 41 29 246 C1, a dustpan with a triangular base shape is known. The dustpan has a symmetric base shape, wherein one leg is formed as a sweeping edge and side walls are arranged on the two other legs. A handle is arranged at the tip at which the two side walls meet. The cleaning work with such dustpans is not ergonomic.

From GB 2168599 A, a dustpan is known in which a stem is arranged on a base body. For proper use, this stem projects at a right angle from the base body. In addition, the connection between the stem and base body has an articulated construction, so that the base body can pivot in the direction of the stem in order to save space.

BRIEF SUMMARY OF THE INVENTION

A general object of the invention is to provide a dustpan that can be operated ergonomically and that can be stowed in a space-saving way.

To this end, a dustpan with a base body is proposed that has an essentially triangular base surface. One edge is constructed as the sweeping edge and the two other edges each have a side wall. A stem can be attached to the base body and this stem, for proper use, projects essentially at a right angle from the base surface. At least one side wall is constructed as a standing surface. By means of the stem, the cleaning work can be performed without bending, and thus ergonomically. In one embodiment, the stem has a length of approximately one meter. Through the construction of one side wall as a standing surface, the dustpan can be stored standing on one side wall and thus on an especially small base surface. The standing surface here can be realized by the entire side wall over its entire surface or in a line along one edge.

The stem can be attached to the base body asymmetrically on one side wall. Through the asymmetric mounting of the stem on the base body, the dustpan is automatically always held so that the sweeping edge is oriented at an angle to the broom while sweeping. Therefore, the dustpan can be used with various brooms, in particular, even with wide ones. The dustpan is advantageously made from a plastic injection die molding. In one embodiment, the base surface can be formed as an oblique-angle triangle. In an oblique-angle triangle, each leg is produced with a different length. Such a configuration improves the ergonomics of the dustpan even more.

The stem can be attached to the base body in an articulated way. The articulated connection allows the dustpan to be folded, so that it can be stowed in an especially compact way. In one embodiment, a latch mechanism can be provided by means of which the stem can be fixed in a working position and in a storage position. This latch mechanism can be formed as a snap connection.

The length of the stem can be adjustable. In an especially advantageous way, the length adjustment is realized by stem parts that can telescope. By means of the length adjustment, the dustpan can be stowed even more compactly. In addition, the length of the stem can be adapted to the user.

The sweeping edge can be arranged on the longest leg of the base body. In this way, the dustpan can be better used with other brooms, in particular normal or wider brooms.

The sweeping edge can have an elastic lip. The elastic lip can be molded onto the sweeping edge by means of a 2-component injection die molding or can be made from a separate component of elastomeric material that is held by a positive fit and/or non-positive fit on the sweeping edge.

The stem can have a T-shaped handle. The T-shaped handle improves the ergonomics of the dustpan even more. In one embodiment, the handle can have a cylindrical or barrel-shaped construction.

A broom can be attached to the stem. With the broom and dustpan, a compact cleaning unit is produced. In this way, the two cleaning tools needed for sweeping are always available together.

The broom can comprise a bristle body and a broom handle, with the broom handle connected in an articulated way to the bristle body. Through the articulated connection, the broom can also be folded in an especially compact way for storage. The joint can in one embodiment be constructed in such a way that the broom can be housed in a space-saving way within the folded-up dustpan.

The length of the broom handle can be adjustable. In an especially advantageous way, the length adjustment is realized by stem parts that can telescope. By means of the length adjustment, the dustpan can be stowed even more compactly. In addition, the length of the stem can be adapted to the user.

The device for length adjustment of the stem and broom handle can be constructed so that an adjustment can be realized in common and simultaneously. The folding of the broom and dustpan can here be performed especially quickly and effectively.

BRIEF SUMMARY OF THE DRAWINGS

A few embodiments of the dustpan according to the invention will be explained in greater detail below with reference to the drawings. These show, each schematically.

DETAILED DESCRIPTION

Figure 1:
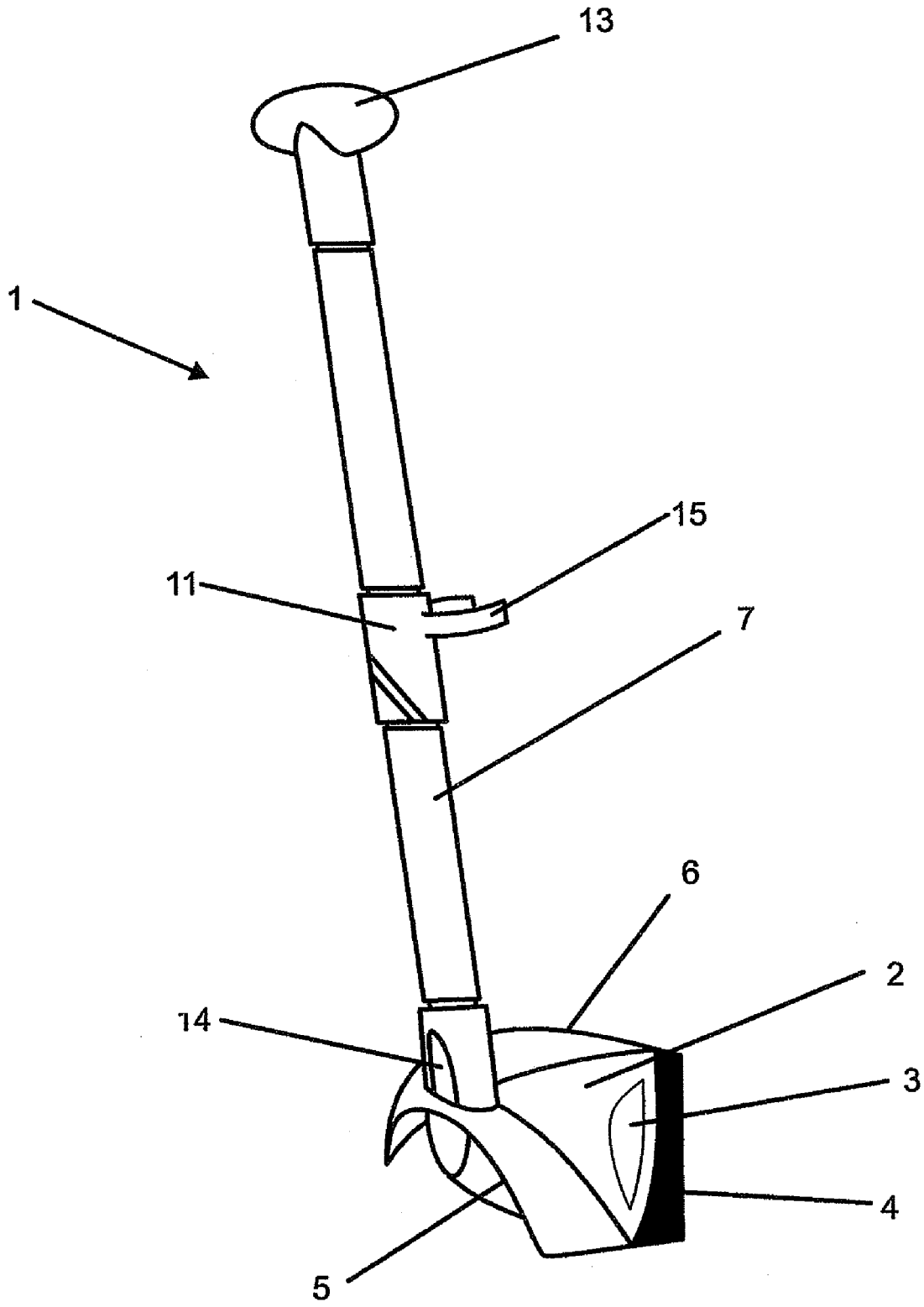
FIG. 1 is a perspective view of a dustpan according to the invention.

FIG. 1 shows a dustpan 1 that is suitable for sweeping while standing. The dustpan 1 comprises a base body 2 with a triangular base area 3. One edge is constructed as the sweeping edge 4 and the two other edges each have a side wall 5, 6 that is constructed integrally, and with the same material, with the base body 2. A stem 7 that projects at a right angle from the base area 3 for proper use is attached in an articulated way to the base body 2. By means of a hinge 14, the base body 2 can be pivoted in the direction toward the stem 7, so that the dustpan 1 can be stored in a space-saving way. For this purpose, the side wall 5 is constructed as a standing surface. The hinge 14 has a latch mechanism that allows the stem 7 to be fixed in a working position and a storage position. The attachment of the stem 7 to the base body 2 is asymmetric to the side wall 5. For connecting the stem 7 and base body 2 there is an adapter that has an at least partially surrounding annular projection. In the working position, this projection engages with a congruent recess of the base body 2 and therefore relieves stress from the joint 14 in the working position. The joint 14 is arranged somewhat elevated to the side walls 5, 6, in order to prevent dust from trickling through the opening of the joint body. The stem 7 has a two-part construction, wherein the two parts can move one in the other in a telescoping way, so that the stem 7 is adjustable in length. In addition, the stem 7 has a device 11 for length adjustment, so that the stem 7 locks in certain positions. A hook 15 on which a broom 8 can be attached is arranged on this device 11. The stem 7 has a T-shaped handle 13 on its free end. In other embodiments, this stem can also be formed with a barrel shape. The dustpan 1 is made from a plastic injection die molding.

Figure 2:
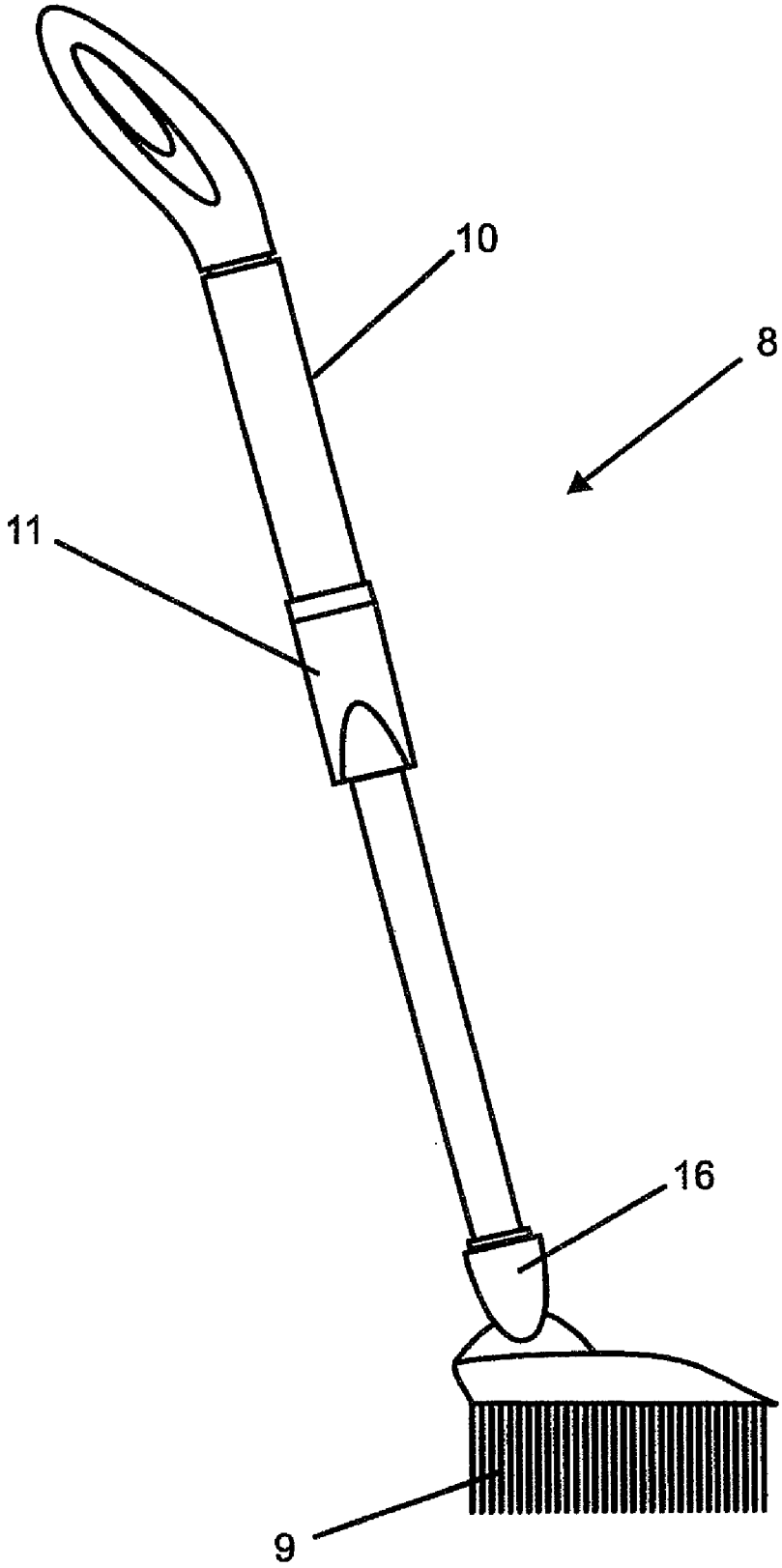
FIG. 2 is a top view of a broom for the dustpan.

FIG. 2 shows a broom 8 that can be attached to the dustpan 1 and that forms a sweeping system with this dustpan. The broom 8 is made from a brush body 9 and a broom handle 10. The broom handle 10 is connected in an articulated way to the brush body 9. The joint 16 by which the brush body 9 is connected to the broom handle 10 is arranged asymmetric to one end of the broom body 9, so that the broom 8 can be folded in an especially compact way. In the cleaning position, there is an obtuse angle between the broom body 9 and broom handle 10 so that the cleaning work is especially ergonomic. The broom handle 10 is also adjustable in length and also has a device 11 for length adjustment. Both devices 11 interact so that an adjustment of the stem 7 and broom handle 10 can be realized in common and simultaneously. For this purpose, adjustment devices are attached to the devices 11 so that they are positioned facing away from each other when the broom 8 is attached to the dustpan 1.

Figure 3:
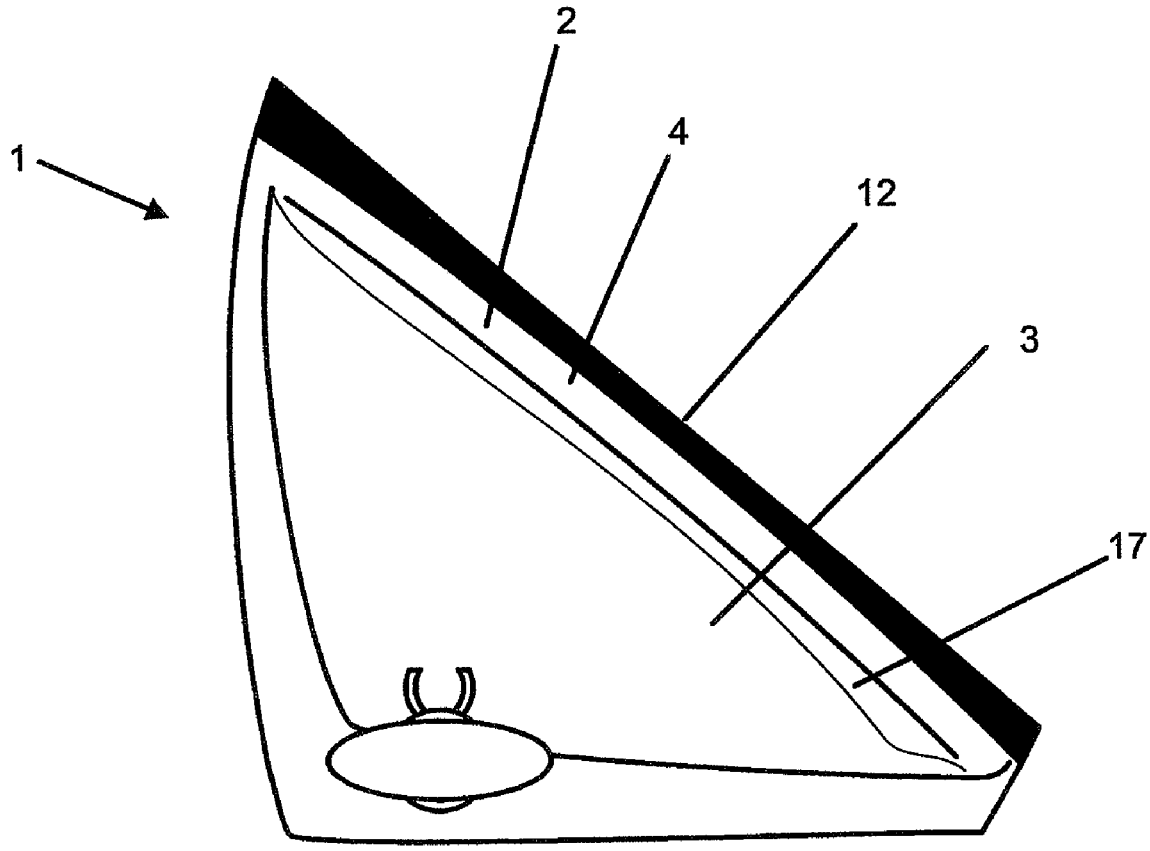
FIG. 3 is a top view of the dustpan.

FIG. 3 shows the dustpan according to FIG. 1 in top view. In the illustrated embodiment, the base area 3 has the shape of an oblique-angle triangle, wherein the sweeping edge 4 is arranged on the longest leg of the base body 2. On the sweeping edge 4, an elastic lip 12 is arranged. According to the construction, this lip 12 can be molded onto the base body 2 or can be attached with a positive/non-positive fit to the sweeping edge. Within the base area 3 there is an elevated section 17 that holds back the dust and dirt swept into the dustpan 1.

Figure 4:
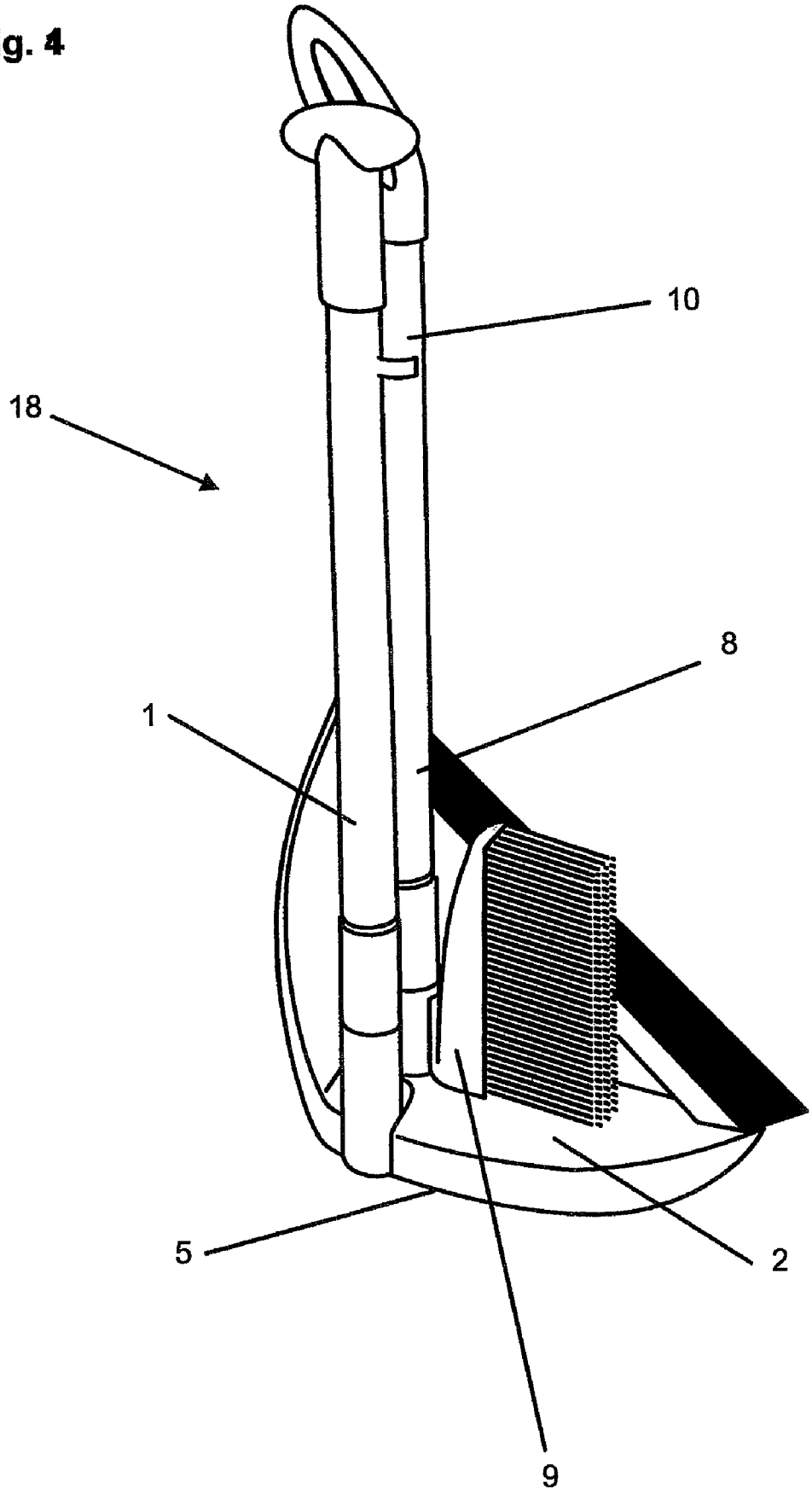
FIG. 4 is a perspective view of a cleaning system made from dustpan and broom.

FIG. 4 shows a sweeping system 18 made from a dustpan 1 according to FIG. 1 and a broom according to FIG. 2. In the figure, the sweeping system 18 is shown folded together. In this case, the sweeping system 18 stands on the side wall 5 of the base body 2 of the dustpan 1. The bristle body 9 of the broom 8 is pivoted in the direction toward the broom handle 10 and the broom 8 is attached to the dustpan 1.

The invention claimed is:

1. A dustpan comprising: a base body having a substantially triangular base area with a first edge constructed as a sweeping edge and second and third edges each having a side wall; and a stem that is attachable to the base body so as to project in substantially perpendicular relation from the base area, the attachment of the stem to the base body being asymmetric relative to one of the side walls and the sweeping edge; wherein at least one side wall of either the second or third edge is constructed as a standing surface defined by the entire surface of the side wall or by a line along the second or third edge and configured such that the dustpan is independently supportable by the standing surface on a storage surface in an upright position with the sweeping edge extending upward from the storage surface.

2. A dustpan according to claim 1, wherein the stem is attachable in an articulated manner to the base body with the handle being movable to an upright position relative to the storage surface when the dustpan is supported by the standing surface in an upright position on the storage surface.

3. A dustpan according to claim 1, wherein the stem is adjustable in length.

4. A dustpan according to claim 1, wherein the sweeping edge is arranged on a longest leg of the base body.

5. A dustpan according to claim 1, wherein the sweeping edge has an elastic lip.

6. A dustpan according to claim 1, wherein the stem has a T-shaped handle.

7. A dustpan according to claim 1, wherein a broom is attachable to the stem.

8. A dustpan according to claim 7, wherein the broom comprises a bristle body and a broom handle, the broom handle being connected in an articulated way to the bristle body.

9. A dustpan according to claim 8, wherein the broom handle is adjustable in length.

10. A dustpan according to claim 9, wherein the stem is adjustable and a device for length adjustment of the stem and broom handle is constructed in such a way that an adjustment of the stem and broom handle can take place in common and simultaneously.

* * * * *